US005709608A

United States Patent [19]

Koury

[11] Patent Number: 5,709,608

[45] Date of Patent: Jan. 20, 1998

[54] AIR-OPERATED RUDDER ASSEMBLY FOR A BOWLING PIN SETTER

[75] Inventor: George David Koury, Show Low, Ariz.

[73] Assignee: George D. Koury, Show Low, Ariz.

[21] Appl. No.: 734,199

[22] Filed: Oct. 21, 1996

[51] Int. Cl.[6] ..... A63D 5/02

[52] U.S. Cl. ..... 473/99; 473/111; 473/106

[58] Field of Search ..... 473/64, 73, 97, 473/98, 99, 106, 110, 111, 114

[56] References Cited

U.S. PATENT DOCUMENTS

| | | | |
|---|---|---|---|
| 3,012,782 | 12/1961 | Larson | 473/99 |
| 4,179,120 | 12/1979 | Hendricks et al. | 473/111 |
| 4,257,595 | 3/1981 | Steiger | 473/73 |
| 4,509,752 | 4/1985 | Schmid | 273/49 |
| 4,640,511 | 2/1987 | Speranza | 273/49 |
| 4,770,417 | 9/1988 | Blair | 273/49 |
| 5,076,582 | 12/1991 | Edwards | 273/49 |
| 5,382,197 | 1/1995 | Koury | 473/111 |

*Primary Examiner*—William M. Pierce

[57] ABSTRACT

A mechanism for air-assisted rudder operation that supplements current rudder assemblies involved in returning bowling balls to the bowler. An electric motor rotating a cam activates and deactivates an air switch which in turn operates an air cylinder causing the rudder of a bowling machine to oscillate. The oscillation prevents bowling pins from entering the ball lift area.

1 Claim, 5 Drawing Sheets

AIR-OPERATED RUDDER ASSEMBLY FOR A BOWLING PIN SETTER

BACKGROUND

1. Field of Invention

This invention relates to the ball elevator area in an AMF 8270 and 8230-machine but not limited to an AMF bowling machine, specifically to an improved manner of returning balls for a bowling machine.

2. Description of Prior Art

Currently, balls are moved out of the ball elevator area with belts and hydraulics or spring shock absorbers. This type of assembly is in constant motion and often does not have the pressure to move bowling pins out of the bowling ball's path to the elevator mechanism. When the bowling ball's path to the elevator mechanism is blocked by bowling pins, and the machine is unable to clear the blockage, manual assistance is required.

OBJECTS AND ADVANTAGES

The air-operated rudder assembly has shown, during a three-month experimental period, that it is capable of pushing several bowling pins out of the ball elevator area. This capability allows for all bowling balls to be returned without manual assistance. The air-operated rudder assembly has also been designed with more than a one second delay that allows all bowling balls, even six pound bowling balls, the opportunity to access the ball elevator area without manual assistance to be returned.

The air-operated rudder assembly has very few moving parts, thus facilitating easy replacement and infrequent maintenance. During the three-month experimental period there has been no maintenance or manual assistance required.

DRAWINGS

DESCRIPTION

Figure 1:
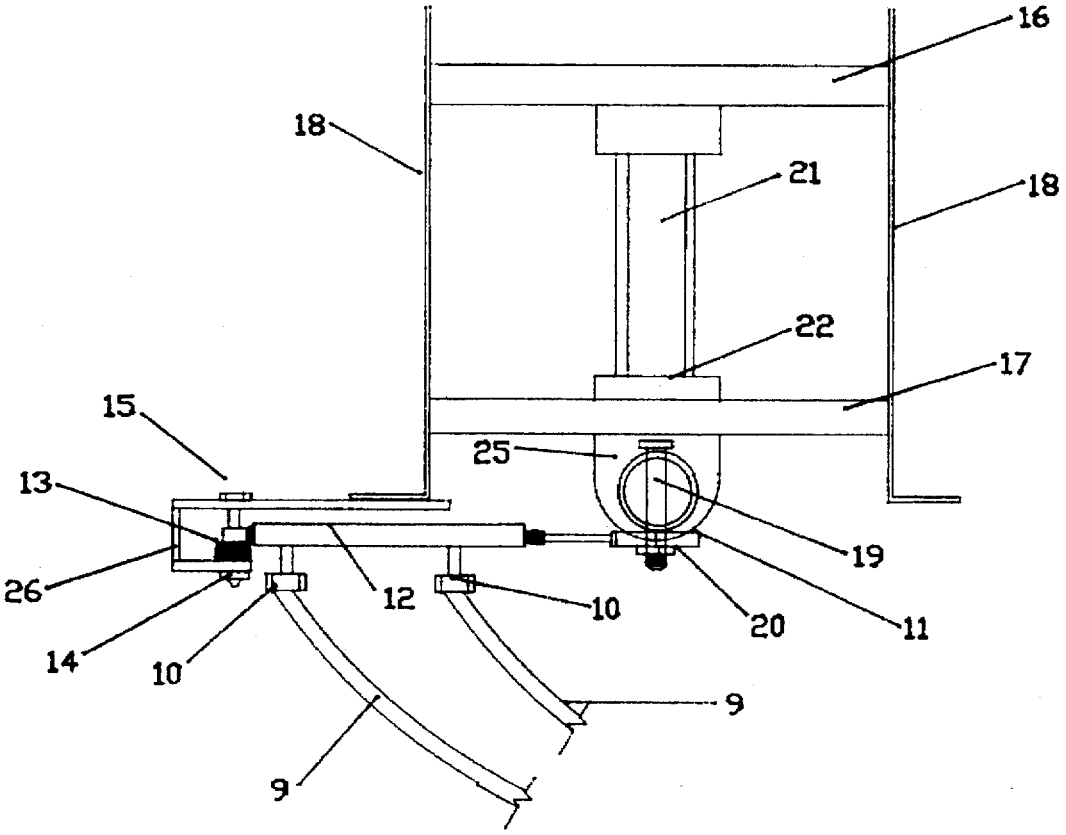
FIG. 1 is a back view of the air cylinder and the bracket attached to the air-operated rudder assembly.
Figures 2, 3:
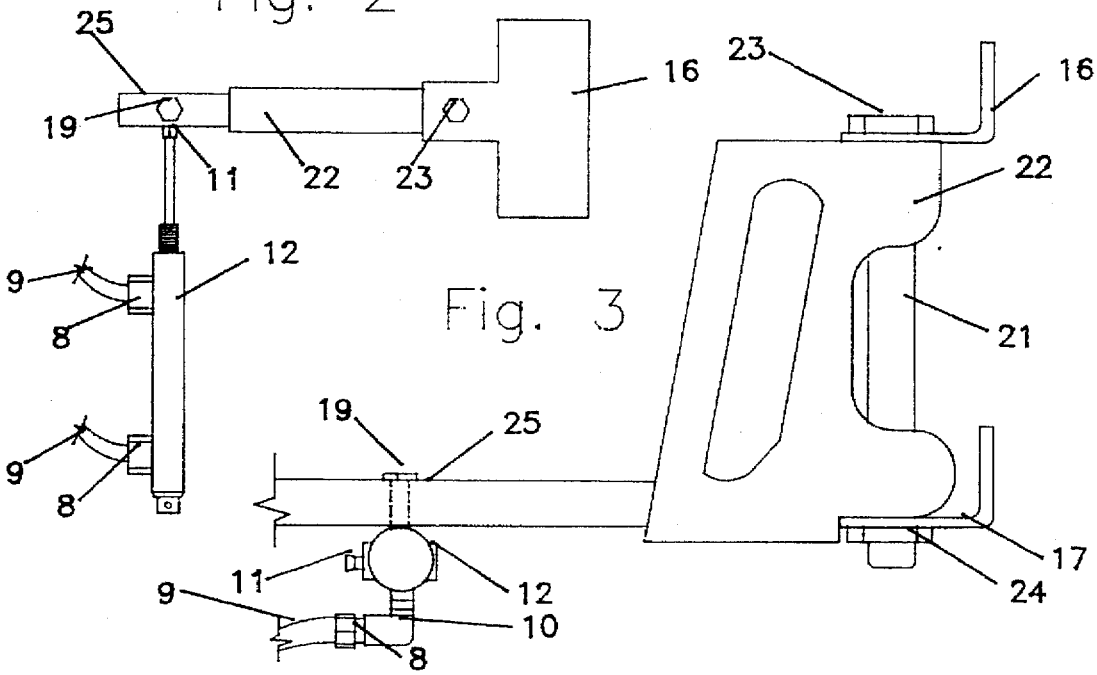
FIG. 2 is a top view of the air cylinder attached to the air-operated rudder assembly.
FIG. 3 is a side view of the air cylinder attached to the air-operated rudder assembly.

Beginning with a ⅛"×4"×6" steel plate 4 which will have two ¼" holes drilled into one of the 4" ends that will match the mounting holes in gear motor 5, mount gear motor 5 with two 10×24×½" screw 2. Cam 1 is fabricated from 2" wide by ½" thick by 3" long stock with an 1½" radius cut across each end. Drill 5/16" hole in the center of a cam that will allow the cam to fit the shaft on gear motor 5. Using set screw 3, attach cam 1 to gear motor 5 shaft. On opposite end of steel plate 4, drill holes to attach air switch 6 to steel plate 4.

Use fitting 7 to adapt fittings of air switch 6 to the compression nut 8 of air line 9. Using ¼" nut 8 attach sufficient lengths of air line 9 to reach air cylinder 12. Use 90 degree fitting 10 to attach air line 9 with ¼" nut 8 to air cylinder 12.

To install to the AMF bowling machines models 8270 and 8230, remove all pulleys and belts from rudder arm 22. Remove rudder arm 22 from the machine. In the bottom of rudder arm 22 five and one half inches from the back drill a 5/16" hole and reinstall rudder arm 22 into the machine. Install double action pivot mount air cylinder 12 into bracket 26 using ¼" bolt 15, spacer 13 and ¼" nut 14. Once double action pivot mount air cylinder 12 is installed into bracket 26, take rudder arm 22 and hold it parallel to both machines. Install rod end 11 to rudder arm 22 using bolt 19 and nut 20 while making sure that air cylinder 12 is extended halfway and is at a 90 degree angle from rudder arm 22. At this point, weld bracket 26 to machine side 18. Using ¼" air line 9, attach both ends of air cylinder 12 using ¼" pipe to ¼" compression 90 degree fitting 10 and ¼" compression nut 8. Run the other ends o ¼" air lines 9 to air switch 6 and attach to fitting 7 and compression nut 8.

Figure 4:
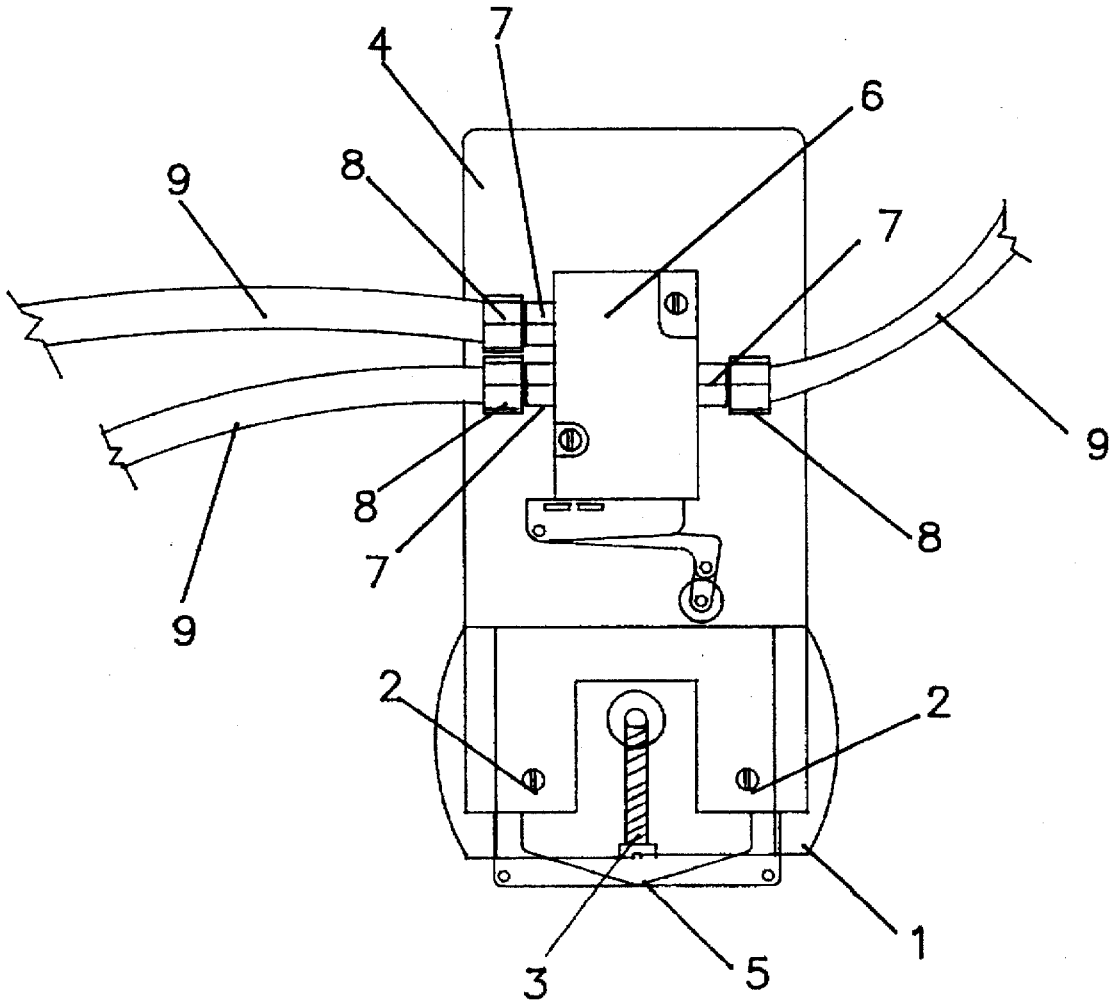
FIG. 4 is a front view of the switch motor assembly.
Figure 5:
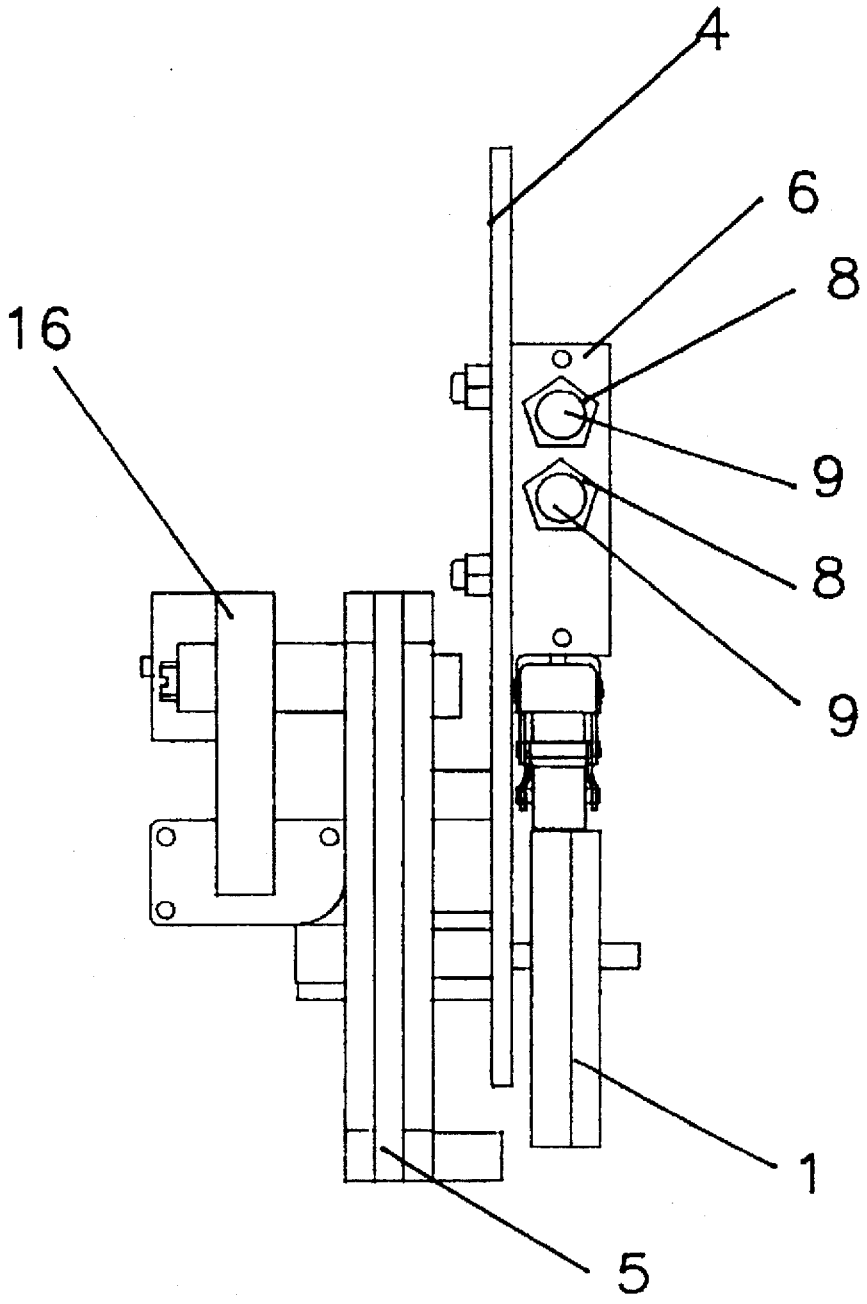
FIG. 5 is a side view of the switch motor assembly.
Figure 6:
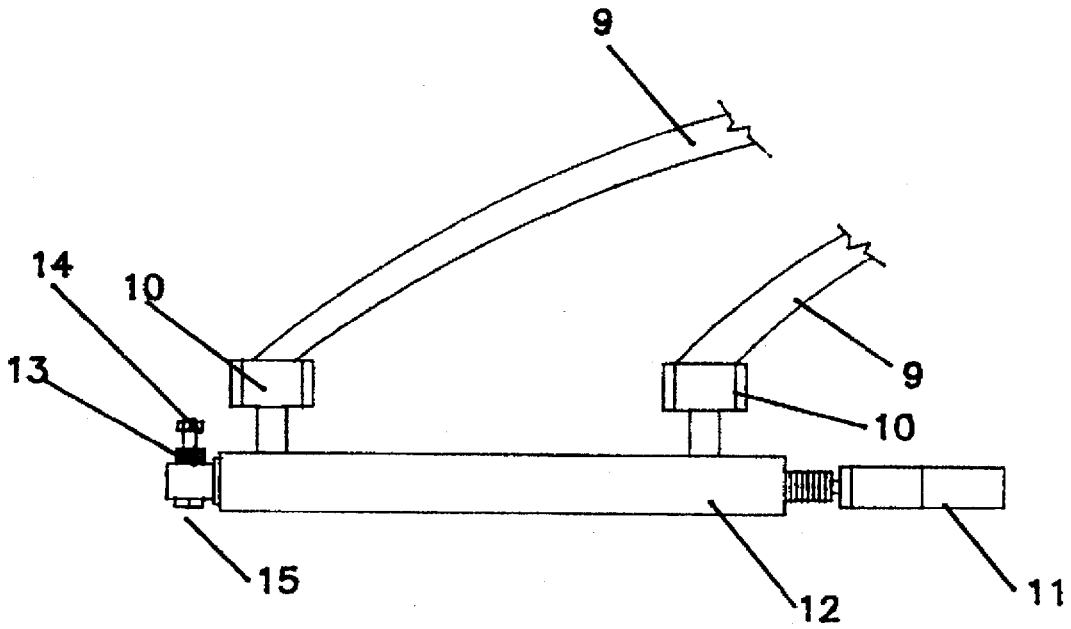
FIG. 6 is a side view of the air cylinder assembly.

The entire assembly shown in FIG. 4 is attached to the bottom of the machine in any convenient place using cable ties. The electrical power fro motor 5 comes from the back end motor circuit of the machine so that motor 5 will come on and run continuously as long as the pin setting machine is on.

CONCLUSION

The Air-Operated Rudder Assembly allows all balls, light or heavy, to be returned without manual assistance even if several bowling pins get into the ball elevator area. The Air-Operated Rudder Assembly uses greater force to move the pins and is designed with a more than one second delay so that any ball will have time to roll down into the ball elevator area. This design can be manufactured at a cost that small business owners could afford which would make their bowling machines run more independently.

I claim:

1. In combination with an automatic pinsetter of the type having an oscillating rudder, an air-operated rudder assembly comprising a substrate having a motor assembly which operates a cam, said cam contacting an air switch to activate said assembly, air lines connecting said air switch to an air cylinder which has a mounting means at one end and a means for mounting another end to said rudder whereby said assembly produces oscillating lateral energy to the rudder arm with a more than one second delay to facilitate bowling pin removal and bowling ball access in the elevator area.

* * * * *